US005768810A

United States Patent [19]

Ahn

[11] Patent Number: 5,768,810

[45] Date of Patent: Jun. 23, 1998

[54] METHOD FOR CARRYING OUT AUTOMATIC SURFACE FINISHING WORK WITH ELECTRO-HYDRAULIC EXCAVATOR VEHICLE

[75] Inventor: Seong-Ho Ahn, Seoul, Rep. of Korea

[73] Assignee: Samsung Heavy Industries Co., Ltd., Seoul, Rep. of Korea

[21] Appl. No.: 754,919

[22] Filed: Nov. 22, 1996

Related U.S. Application Data

[63] Continuation of Ser. No. 364,935, Dec. 28, 1994, abandoned.

[30] Foreign Application Priority Data

Apr. 29, 1994 [KR] Rep. of Korea ..... 94-9369

[51] Int. Cl.[6] ..... E02F 5/02

[52] U.S. Cl. ..... 37/348; 364/424.07

[58] Field of Search ..... 37/348, 902, 443, 37/382; 364/424.07; 414/699, 695.5; 172/2, 4.5

[56] References Cited

U.S. PATENT DOCUMENTS

| | | | |
|---|---|---|---|
| 4,829,418 | 5/1989 | Nielsen et al. . | |
| 5,065,326 | 11/1991 | Sahm | 414/699 X |
| 5,088,020 | 2/1992 | Nishida et al. | 414/699 X |
| 5,160,239 | 11/1992 | Allen et al. | 414/699 |
| 5,182,908 | 2/1993 | Devier et al. | 60/420 |
| 5,201,177 | 4/1993 | Kim | 60/426 |
| 5,214,916 | 6/1993 | Lukich | 60/431 |
| 5,257,177 | 10/1993 | Bach et al. | 414/699 X |
| 5,308,219 | 5/1994 | Lee et al. . | |
| 5,356,259 | 10/1994 | Hanamoto et al. | 37/348 X |
| 5,361,211 | 11/1994 | Lee et al. | 414/699 X |
| 5,404,661 | 4/1995 | Sahm et al. | 37/348 |
| 5,424,623 | 6/1995 | Allen et al. | 414/695.5 |
| 5,434,785 | 7/1995 | Myeong-hün et al. | 37/902 X |
| 5,438,771 | 8/1995 | Sahm et al. | 37/348 |
| 5,442,868 | 8/1995 | Ahn | 37/348 |
| 5,446,980 | 9/1995 | Rocke | 37/348 |
| 5,446,981 | 9/1995 | Kamada et al. | 37/348 |
| 5,461,803 | 10/1995 | Rocke | 414/699 X |
| 5,469,646 | 11/1995 | Takamura | 414/699 X |
| 5,572,809 | 11/1996 | Steenwyk et al. | 37/348 |

*Primary Examiner*—Terry Lee Melius
*Assistant Examiner*—Victor Batson
*Attorney, Agent, or Firm*—Antonelli, Terry, Stout, & Kraus, LLP

[57] ABSTRACT

A method for carrying out a surface finishing work with an electronically controlled hydraulic excavator is disclosed. The present invention includes the steps of: selecting an automatic surface finishing work, and inputting a desired work angle (S1); detecting the current positions of the respective attachment (S32); deciding the bucket maintaining angle relative to the horizontal plane (S3); correcting the work angle relative to the equipment inclination (S4); judging as to whether the control lever for the dipper stick is manipulated by the operator (S7); judging as to whether or not there is a swinging operation by the operator (S9); correcting the swinging angle and the inclination angle when carrying out the swinging operation (S10); compensating the departure amount of the bucket end from the initially inputted work plane during the swinging (S11); calculating the linear velocity of the bucket end L which is proportionate to the actuation of the control lever for the dipper stick (S12); deciding a velocity for satisfying the positions of the cylinders corresponding to the intended angles of the bucket, the dipper stick and the boom (S15); making corrections for feasible velocities calculating the target velocities of the respective cylinders for arriving to the target positions (S17); correcting the velocities of the cylinders compensating the velocity of the cylinders and the fluid discharge amount of the pump (S19); and terminating the operation after the end of the work (S21).

6 Claims, 5 Drawing Sheets

METHOD FOR CARRYING OUT AUTOMATIC SURFACE FINISHING WORK WITH ELECTRO-HYDRAULIC EXCAVATOR VEHICLE

This application is a Continuation of application Ser. No. 08/364.935, filed Dec. 28, 1994 now abandoned.

BACKGROUND OF THE INVENTION

1. Field of the invention

The present invention relates to a method for carrying out an automatic surface finishing work with an electro-hydraulic excavator vehicle, in which the operator can carry out the generally most difficult surface finishing work in an easy manner with an electro-hydraulic excavator vehicle.

2. Description of the prior art

Electro-hydraulic excavator vehicles have complicated structures including various sensors, electronic proportional valves, and micro-processors. In this context, there appeared a need for an excavator vehicle in which a non-skilled person can carry out the operation in an easy and speedy manner.

In the surface finishing work with a conventional excavator vehicle, the operator has to manipulate three control levers manually, and therefore, an accurate manipulation of the control levers is very difficult.

Particularly, if the excavator vehicle is inclined, it is very difficult to attain the intended slope.

Particularly, in the case where the surface finishing work is carried out while performing swinging, that is, in the case where the surface finishing work is carried out by manipulating four control levers, the operation becomes a highly difficult task.

In the conventional auto surface finishing work with prior art electro-hydraulic excavator vehicles, sensors are installed only on the three pivot points of the boom, the dipper stick and the bucket, and a predetermined straight line is tracked, thereby carrying out the surface finishing work.

In conventional automatic surface finishing work in which only a straight line is traced, running has to be made each time when work is carried out. If the slope of the ground is not the same after the running, the work surface can be made even with the already worked work surface only by arbitrarily varying the work angle. Therefore, the operator experiences a feeling of difficulty.

SUMMARY OF THE INVENTION

On the other hand, in the present invention, even if a swinging is additionally carried out, a departure is not made from the pre-set work plane. For this purpose, a swinging sensor and a slope sensor are additionally installed, so that the boom, the bucket and the dipper stick can be automatically controlled, thereby improving the operation efficiency.

Under this condition, swinging is not made by tracking along a straight line but instead by tracking a plane, and therefore, surface finishing work can be carried out in an easy manner on any sloped surface.

Therefore, in the present invention, the three attachments for the boom, the bucket and the dipper stick are driven by using only a single control lever for the dipper stick. Under this condition, when swinging is carried out, the end of the bucket geometrically departs from the plane.

Thus if the control lever for the dipper stick is manipulated simultaneously with swinging, then the surface finishing work is done along the pre-set work plane, while if a swinging is made, a departure is made from the work plane.

Therefore, a smooth returning has to be made by manipulating the control lever for the dipper stick, and the surface finishing work has to be carried out again.

Thus the three attachments are driven in such a manner that a movement is made along a straight line so as to be fit to the work angle, and a control is made so that the bucket is maintained at a certain angle relative to the horizontal plane, thereby carrying out the surface finishing work.

The present invention is intended to overcome the above described problems of the conventional techniques.

Therefore it is the object of the present invention to provide a method for carrying out an automatic surface finishing work with an electronically controlled hydraulic excavator, in which the work angle can be varied during the swinging of the excavator for continuing the surface finishing work on the work plane.

In achieving the above object, the method for carrying out a surface finishing work with an electronically controlled hydraulic excavator according to the present invention, includes the steps of: selecting an automatic surface finishing work on a key pad 5, and inputting a desired work angle θw into the main processor 10 by the operator (S1); detecting and reading the current signal values of the angles of a boom 100, dipper stick 110 and a bucket 120, the turning angle of the swinging, and the slope of the upper portion of excavator vehicle, through position sensors (S2); deciding the bucket maintaining angle relative to the horizontal plane based on the read signal values (S3); correcting the work angle τ to make the inputted work angle (based on the inclination of the equipment) fit to the absolute horizontal plane (S4); deciding the initial positions of the bucket end L and the bucket joint J with respect to a rectangular coordinate system whose origin is point A and, an upper rotary portion of the excavator vehicle (S5); deciding the initial position of the bucket end L with respect to a rectangular coordinate system whose origin is point O (S6); judging as to whether or not the control lever for the dipper stick as an arbitrary control lever is manipulated if the control lever has not been manipulated carrying out step S20 (S7); deciding the current position of the bucket joint J with respect to the rectangular coordinate having an origin at point A, after manipulation of the control lever for the dipper stick (S8); judging as to whether there is a swinging operation by the operator, and then, carrying out step S12 if there is none (S9); reading the swinging angle and the inclination angle of the upper portion of the equipment to correct the work angle τ when carrying out the swinging operation (S31); calculating the departure amount h of the bucket end from the initially inputted work plane, when the buck end L departs from the work plane during the swinging (S11); calculating the linear velocity of the bucket end L which is proportionate to the actuation of the control lever for the dipper stick (S12); deciding the next position to which the pivot point of bucket J is to be positioned with respect to the rectangular coordinate system having an origin at point O (S13); deciding a boom angle θbm, a dipper stick angle θds for the position of bucket pivot point J and a bucket angle θbk for maintaining the initial bucket angle with respect to horizontal line, which correspond to the positional values of step S13 (S14); deciding a speed for satisfying positions $d_{bm}$, $d_{ds}$ and $d_{bk}$ of the cylinders of the respective attachment corresponding to the intended angles of the bucket 120, the dipper stick 110 and the boom 100 calculated at step S14 (S15); making corrections for possible velocities without varying the velocity ratio of the respective cylinders within the range of the dischargeable fluid amount from the pump currently, and then, re-setting the intended positions $d_{bm}$, $d_{ds}$, and $d_{bk}$ of the cylinders (S16); calculating the target velocities of the respective cylinders for positioning at the target positions by utilizing the position values $d_{bm}$, $d_{ds}$, and $d_{bk}$ by a position control section 130 (S17); correcting the velocities of the cylinders and the current amount of the fluid dischargeable by the pump, while maintaining the target velocity ratio of the respective cylinders (S18); compensating the velocity based on the position values obtained based on the current work status which is measured by a position sensor 15 and based on the discharging amount of the pump (S19); converting the digital signals of the compensated velocity signals into analog signals by means of first and second D/A converters 35 and 40 for outputting voltages to a first amplifier 36 and to a second amplifier 41 for a main control valve so as to output currents through first and second electronic proportional valves 50 and 45, and activating the pumps with the currents to drive respective hydraulic cylinder or motor 90, 91, 92, 93, 94 and 95 within a main control valve 80 (S20); and terminating the operation after an end of the work if the operator has inputted a releasing signal for the surface finishing work, and returning to step S7 if the releasing signal has not been inputted (S21).

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
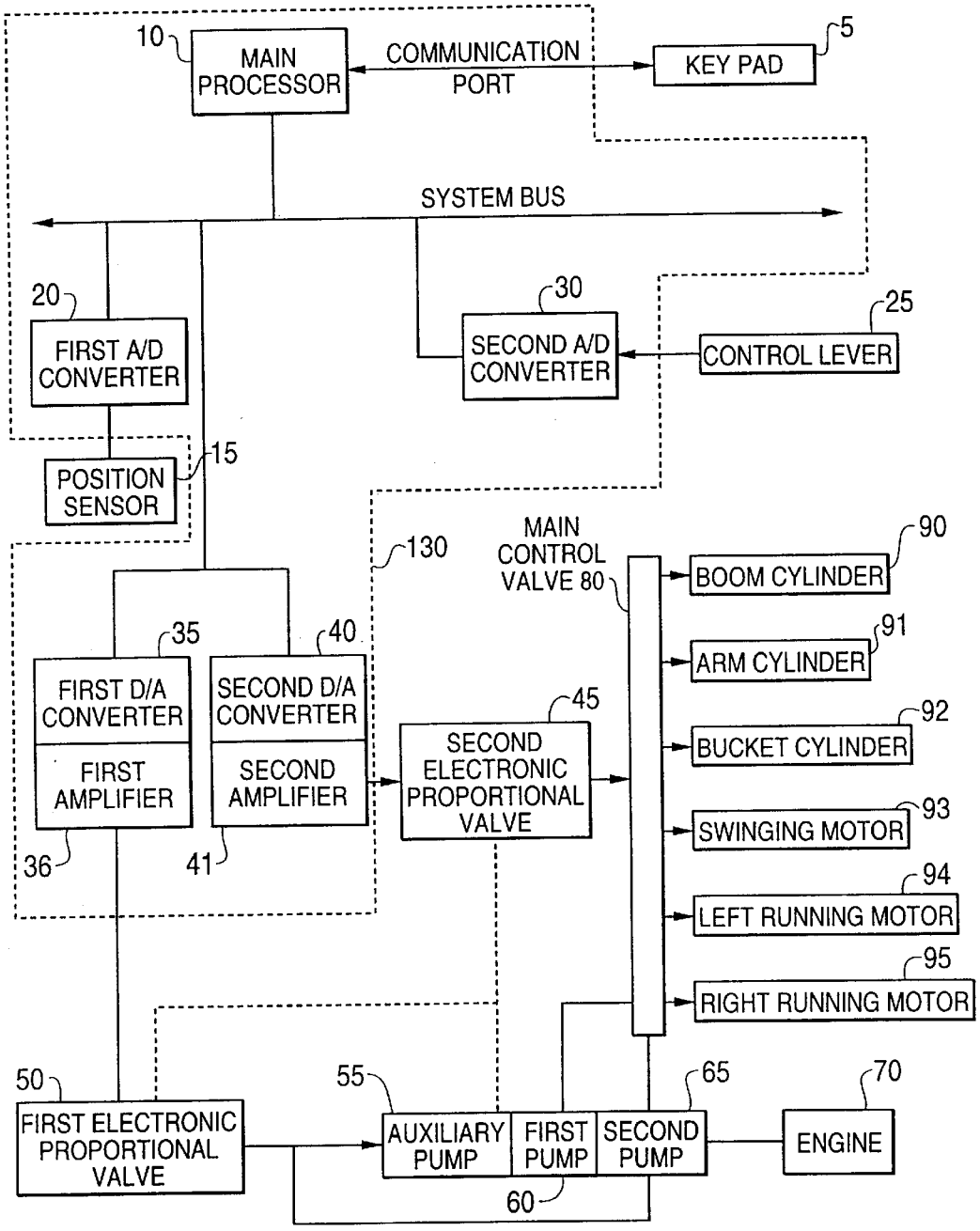
FIG. 1 illustrates a block diagram showing the constitution of the electronically controlled hydraulic system according to the present invention.

FIG. 1 is a block diagram showing the constitution of the hydraulic control system according to the present invention.

The constitution and operation of the system of FIG. 1 will be described.

First, the operator presses an "automatic surface finishing" selection button of a key pad 5, and inputs a work angle which is suitable to the work environment. Then the automatic surface finishing function and the work angle are transmitted through a communication port to a main processor 10 which is the controller.

When the work angle is transmitted, the main processor 10 reads respective position sensors 15 to detect the position and the inclination of the equipment for the current boom, dipper stick, bucket and swing through a system bus. The analogue signals thus read are transmitted through a system bus to a first A/D converter 20 which then converts the signals into digital signals.

An equation for the work plane is set up based on the work angle and the initial position of the bucket end of the excavator utilizing the position signals which were read in the above described manner. Then a control lever for the dipper is manipulated by the operator. Then the analog signals which correspond to the manipulations are converted into digital signals by a second A/D converter 30, so that the main processor 10 can determine the linear velocity of the bucket end in accordance with the manipulation amount.

Proportionately to the linear velocity, the next point of a pivot point of bucket J is determined. Then if the control lever 25 is manipulated, the swing and inclination angle are read again to calculate the deviation of the bucket end from the initially set work plane. Thus the work angle is re-determined to determine the position of the point J, so that the bucket end would not deviate from the work plane.

In order to reach the position of the point J, the positions (angles) of the cylinders of the boom and dipper stick are determined.

The position of the bucket makes it possible to calculate the bucket angle relative to the horizontal plane at the time of the starting of the work.

The calculated angles for the boom, the dipper stick and the bucket are converted into positions of the cylinders, and, based on these position values, target velocity is formed. For this purpose, the required fluid amounts are discharged from an auxiliary pump 55, a first pump 60 and a second pump 65.

The main processor 10 outputs command digital signals of the fluid amount to be discharged for the respective attachments, and these digital signals are converted by a first D/A converter 35 and a second D/A converter 40 which output them in the form of analog signals. Then voltages are supplied to a first amplifier 36 for the second pump 65, the first pump 60 and the auxiliary pump 55 (which are driven by an engine 70), and to a second amplifier 41 which is for a main control valve 80.

The outputted voltages are converted by the first amplifier 36 into currents. Thus the currents which are outputted from the first amplifier 36 are supplied to a first electronic proportional valve 50 for a pump, while the current signals which are outputted from the second amplifier 41 are supplied to a second electronic proportional valve 45 for the main control valve 80.

Under this condition, the first electronic proportional valve 50 produces a pilot pressure to adjust a swash plate of the first pump 60 or the second pump 65, so that the desired discharge amount of the fluid would be sent to the main control valve 80.

The second electronic proportional valve 45 for the main control valve 80 also produces a pilot pressure. Thus, there are adjusted the respective strokes of the spools such as a rightward running motor control spool, a leftward running motor control spool, a swinging motor control spool, an arm control spool, a bucket control spool, and a boom control spool within the main control valve 80. Thus, the hydraulic fluids from the pumps 55, 60 and 65 are distributed to a boom cylinder 90, an arm cylinder 91, a bucket cylinder 92, a swinging motor 93, a leftward running motor 94 and a rightward running motor 95, thereby driving them.

The automatic surface finishing work with an electronically controlled hydraulic excavator based on the system of FIG. 1 will be described referring to the flow chart of FIG. 2.

Figure 4:
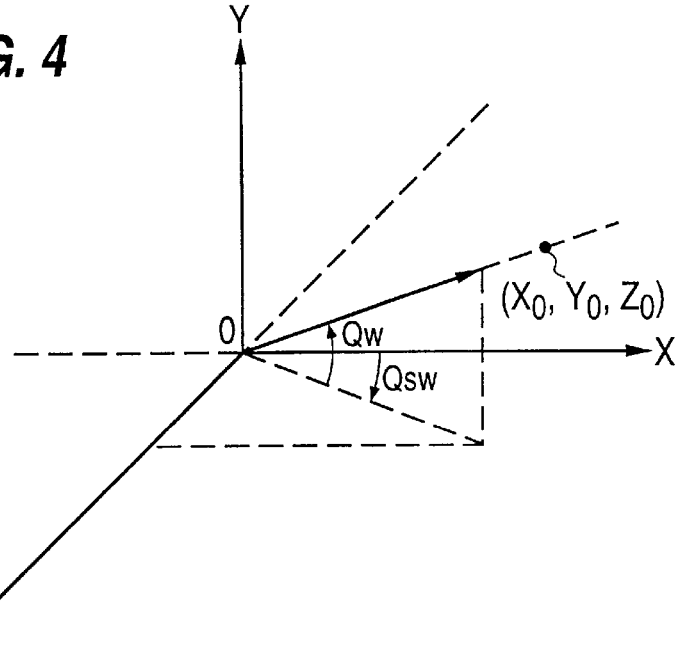
FIG. 4 is a graphical illustration for setting the work plane.
Figure 5:
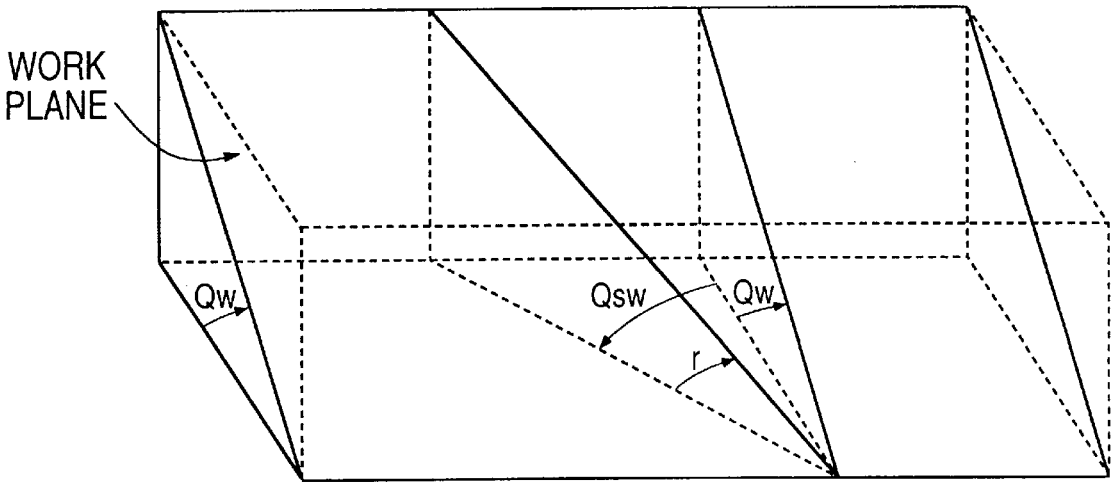
FIG. 5 illustrates work angle compensation for a swinging.

For making descriptions referring to FIG. 2, referring will be made to the side view of the excavator of FIG. 3, to the work plane setting illustration of FIG. 4, and to work angle compensating illustration of FIG. 5 during a swinging.

Figure 2A:
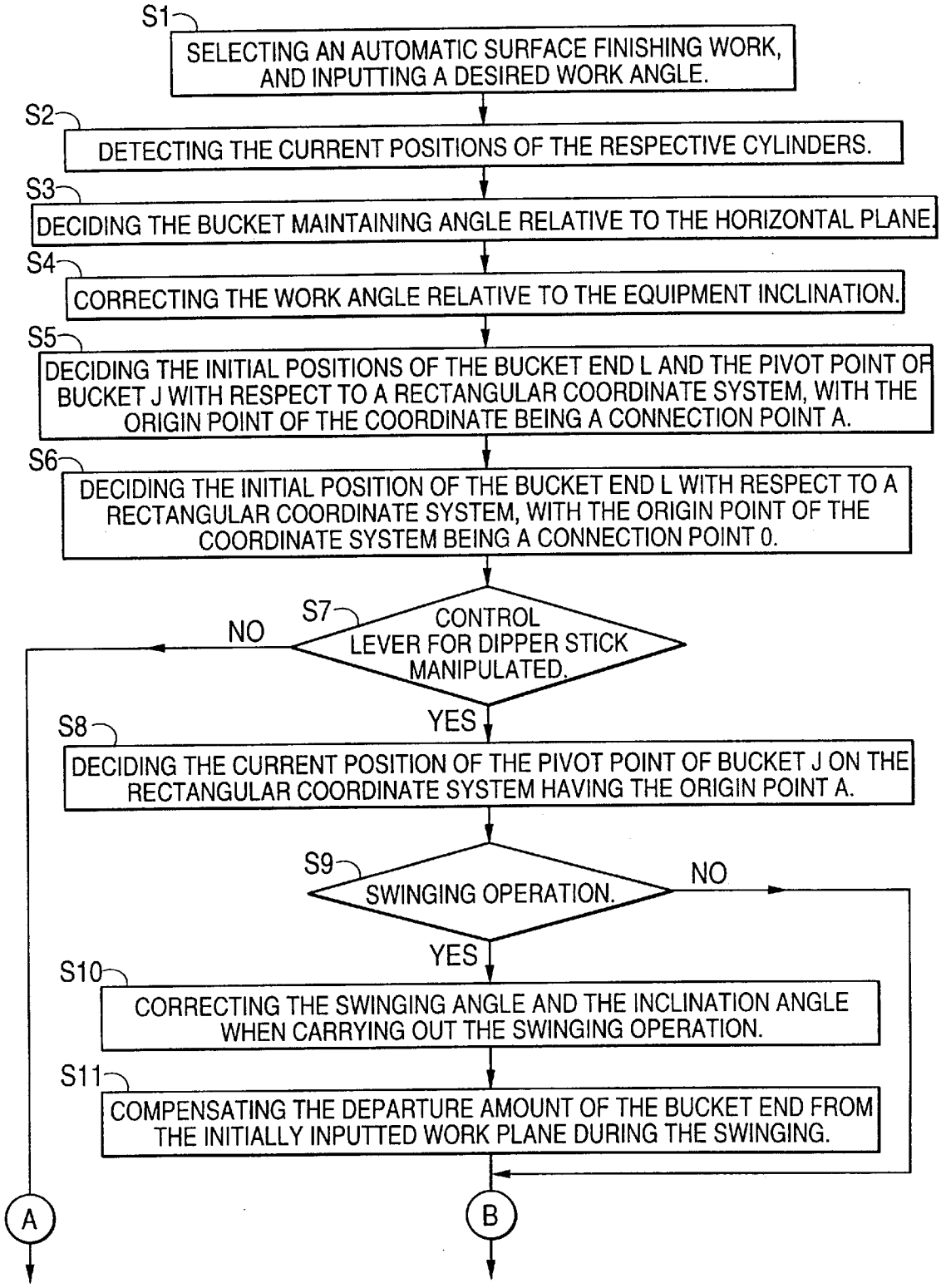
FIGS. 2A and 2B are a flow chart for the present invention.
Figure 2B:
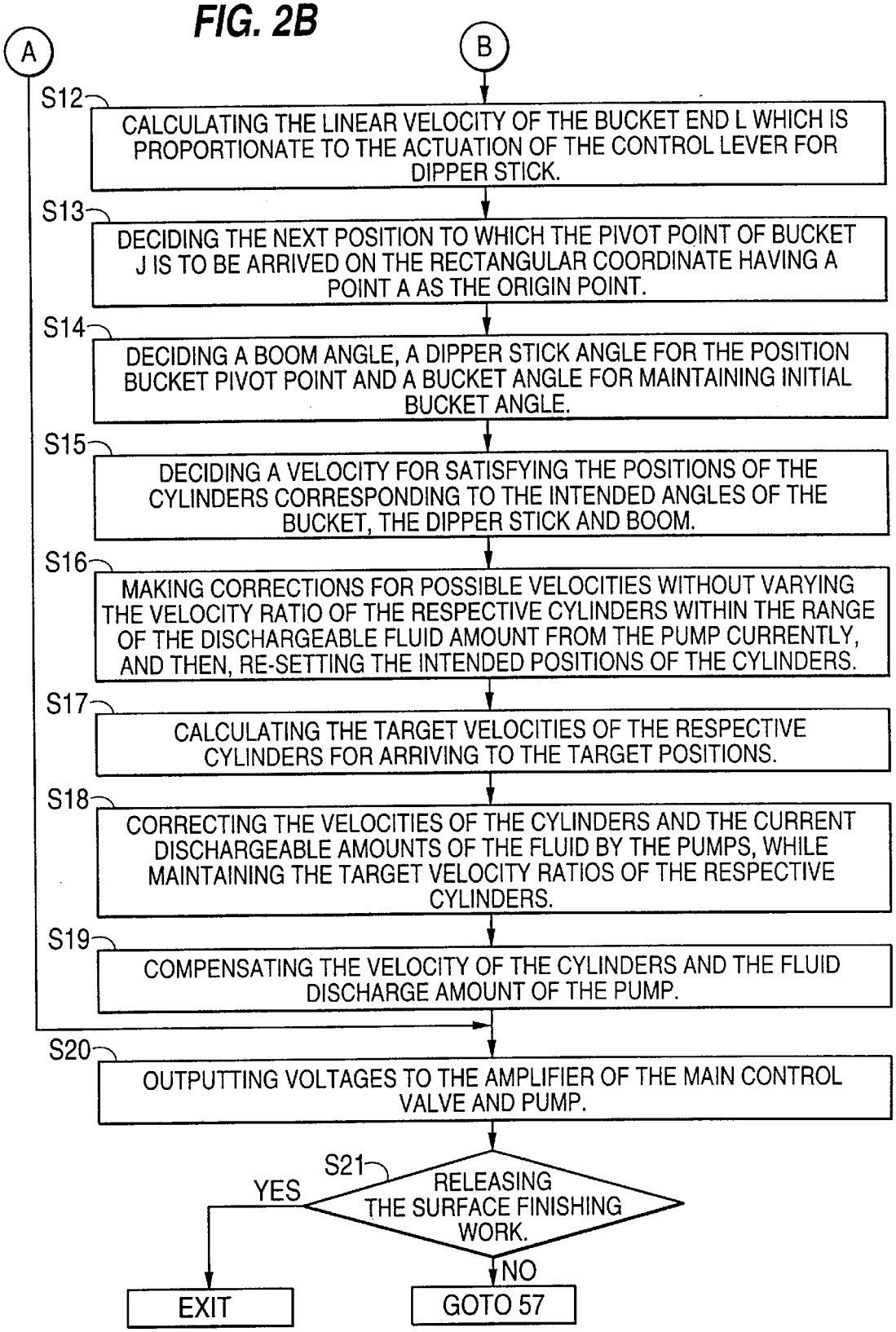

First, at step 1 (S1) of FIG. 2, the operator selects automatic surface finishing work, and inputs the desired work angle θw. Then, reading is made of the signal values for a current angle θbm of the pivot point of the boom 100, a current angle θds of the dipper stick 110, a current angle θbk of the bucket 120, a turning angle θsw of the swinging, an inclination angle θp (pitching) of the upper portion of the equipment, and a rolling angle θr of FIG. 3. At step 2 (S2), the positions of the respective attachments are detected through the respective position sensors 15.

At step 3 (S3), based on the position angle, a bucket maintaining angle Φ (=θbm+θds+θbk) relative to the horizontal surface is decided. Then, at step 4 (S4), the current status of the equipment is analyzed, and the operator corrects the work angle τ in such a manner that the work angle inputted by the operator would be suitable for the absolute horizontal surface relative to the equipment inclination. For this purpose, the following formula is utilized.

$$\tau = a\tan(\tan\theta w\cos\Delta\theta sw(\cos\theta r+\sin\theta r\tan(\theta r - a\tan(\tan\theta w\sin\Delta\theta sw))))$$

Figure 3:
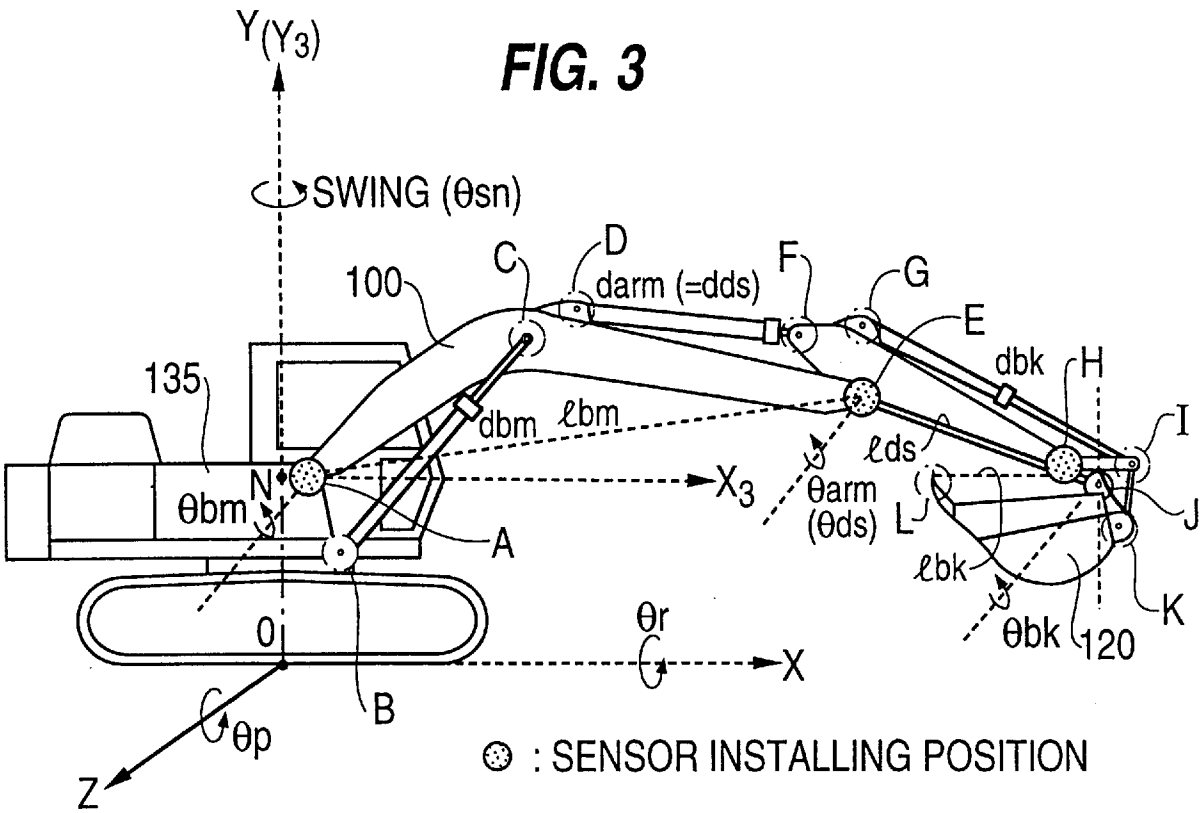
FIG. 3 is a side view of the hydraulic excavator applicable to the method of the present invention.

At step 5 (S5), initial positions of the bucket end L and the pivot point of bucket J which is the connection point between the dipper stick 110 and the bucket 120 are determined on a rectangular coordinate which has an original point A at the point where the upper rotary portion 135 and the boom 100 of FIG. 3 are connected together.

$$Jx30 = lbm\cos(\theta bm+\theta p)+lds\cos(\theta bm+\theta ds+\theta p)$$

$$Jy30 = lbm\sin(\theta bm+\theta p)+lds\sin(\theta bm+\theta ds+\theta p)$$

$$Lx30 = Jx30+lbk\cos(\theta bm+\theta ds+\theta bk+\theta p)$$

$$Ly30 = Jy30+lbk\sin(\theta bm+\theta ds+\theta bk+\theta p)$$

In the above formulas, lbm, lds and lbk indicate respectively the lengths of boom, dipper stick and bucket.

At step 6 (S6), an initial position (XO, YO, ZO) of the bucket end is determined on a coordinate which has an original point O which is the contact point between the plane and the bottom center of the wheel of FIG. 3.

$$XO = cs\ cp(lx+LEN_AN) - cs\ sp\ cr(ly+LEN_NO)+ss\ sr(ly+LEN_NO)$$

$$YO = sp(lx+LEN_AN)+cp\ cr(ly+LEN_NO)$$

$$ZO = -ss\ cp(lx+LEN_AN)+ss\ sp\ cr(Ly_LEN_NO)cs\ sr(ly+LEN_NO)$$

In the above formulas, the new symbols are defined respectively as follows.

$$lx = lbm\cos(\theta bm)+lds\cos(\theta bm+\theta ds)+lbk\cos(\theta bm+\theta ds+\theta bk),$$

$$cp = \cos(\theta p),\ sp = \sin(\theta p),\ cr = \cos(\theta r),$$

$$sr = \sin(\theta r),\ cs = \cos(\theta sw),\ ss = \sin(\theta sw).$$

Further, LEN_AN indicates the straight length of the distance between the point A and N of FIG. 3.

At step 7 (S7), when the surface finishing work is carried out by driving the 3 attachments or 2 attachments of the boom, the dipper stick and the bucket, the main processor 10 makes a judgment as to whether the operator used the control lever 25 for the dipper stick as an arbitrary one of the control levers, or used other executing means. If not used it, a next step 20 (S20) is carried out.

If it is found a step 7 (S7) that the operator used the control lever 25 for the dipper stick or other executing means, then not the initial value but the current value of the pivot point of bucket J is calculated. That is, a calculation is made as to the current value of the bucket joint J on a rectangular coordinate which has the point A of FIG. 3 as the original point, at step 8 (S8).

$$Jx3 = lbm\cos(\theta bm+\theta p)+lds\cos(\theta bm+\theta ds+\theta p)$$

$$Jy3 = lbm\sin(\theta bm+\theta p)+lds\sin(\theta bm+\theta ds+\theta p)$$

At step 9 (S9), the main processor 10 makes a judgment as to whether the operator has made a swinging operation. If there has been no swinging operation, a next step S12 is carried out.

If there has been a swinging operation at step S9, then, at step 10 (S10), the swinging angle and the inclination angle of the upper portion of the equipment are read, and then, the work angle τ is modified.

$$\tau = a\tan(\tan\theta w\cos\Delta\theta sw(\cos\theta r+\sin\theta r\tan(\theta r - a\tan(\tan\theta w\sin\Delta\theta sw))))$$

At step 11 (S11), when the bucket end L departs from the work plane as a result of the swinging, the departure amount of the bucket end is calculated and compensated, so that the bucket end L would not be departed from the initially set work plane.

For this purpose, the initial position (Jx30, Jy30) of the bucket joint are re-set based on the following formula.

$$-\sin(\theta w)\cos(\theta swo)X+\cos(\theta w)Y+\sin(\theta w)\sin(\theta swo)Z = -\sin(\theta w)\cos(\theta swo)XO+\cos(\theta w)YO+\sin(\theta w)\sin(\theta swo)ZO$$

When the swinging operation is begun, the position of the bucket end L departs from the work plane, and therefore, a compensation has to be carried out as much as the departure amount.

Based on the method of step 8 (S8), the position (X, Y, Z) of the bucket end L is determined in a rectangular coordinate having a point O of FIG. 3 as the origin point. At this position, the amount h of the departure from the work plane is calculated.

$$h\ (Y + sgs\ cgs\ XO - cga\ YO - sga\ sgs\ ZO - sga\ cgs\ X + sga\ sgs\ Z) * \cos(a\tan(tga(\sin(\theta sw - \theta swo))))/\cos(\theta r - (a\tan(tga(\sin(\theta sw - \theta swo)))))$$

In the above, θswo indicates the initial swinging position, and other symbols are as follows.

$$sga = \sin(\theta w),\ cga = \cos(\theta w),\ Tga = \tan(\theta w),$$

$$cgs = \cos(\theta swo),\ sgs = \sin(\theta swo).$$

The initial positions of the bucket end and the pivot point of bucket are shifted as much as the departure amount.

At step 12 (S12), a calculation is made on a linear velocity J of the pivot point of bucket J (or the bucket end) which is proportionate to the operation amount of the control lever 25 for the dipper stick of FIG. 1.

At step 13 (S13), a determination is made of the position to which the pivot point of bucket J is destined on a rectangular coordinate having the point A of FIG. 3 as the origin point.

$$Jx3 = Jx3+J\cos(\tau)ts$$

$$Jy3 = \tan(\tau)(Jx3 - Jx30)+Jy30$$

At step 14 (S14), correspondingly with the values of Jx3 and Jy3, calculations are made on the boom angle θbm, the dipper stick angle θds and the buck angle θbk for maintaining the initial bucket angle.

$$\theta bm = a\tan(Jy3/Jx3) + a\cos((lbm^2 - lds^2 + Jx3^2 + Jy3^2)/(2\,lbm\sqrt{(Jx3^2 + Jy3^2)^2})) - \theta p$$

$$\theta ds = -a\cos(Jx3^2 + Jy3^2 - lbm^2 - lds^2)/(2\,lbm.lds))\quad \theta bk = \Phi - \theta bm - \theta ds$$

At step 15 (S15), cylinder positions of the respective attachments are calculated based on the target angles θbm, θbk and θds of the boom 100, the bucket 120 and the dipper stick 110 which have been calculated at step 14 (S14).

$$d_{bm} = (LEN_AB)^2 + (LEN_AC)^2 - 2*LEN_AB*LEN_AC*\cos(ANG_CAE + ANG_BAX3 + \theta bk))^2$$

$$d_{ds} = (LEN_DE)^2 + (LEN_EF)^2 - 2*LEN_DE*LEN_EF*\cos(ANG_ALPH7 - \theta ds))^2$$

$$d_{bk} = ((LEN_GH)^2 + (LEN_HI)^2 - 2*LEN_GH*LEN_HI*\cos(\phi))^2$$

$$\alpha = \pi - (\theta bk + ANG_LJK + ANG_HJE)$$

$$c6 = ((LEN_JK)^2 + (LEN_HJ)^2 - 2*LEN_JK*LEN_HJ*\cos(\alpha))^2$$

$$\Phi = a\cos(c6)^2 + (LEN_HI)^2 - (LEN_IK)^2/(2*LEN_HI*c6)$$

$$\beta = a\cos(LEN_HJ)^2 + (c6)^2 - (LEN_JK)^2)/(2*c6\ LEN_HJ))$$

$$\phi = ANG_GHJ - \Phi - \beta$$

In the above, LEN_AB indicates the distance between the joint A and the joint B, and ANG_ABC indicates the angle between the line AB and the line BC. Further, ANG_ALPHA7 is defined as follows.

$$ANG_ALPHA7 = \pi - ANG_JEF - ANG_CED - ANG_BEC$$

Then the cylinder velocities, which can satisfy the cylinder positions $d_{bm}$, $d_{bk}$ and $d_{ds}$ for the boom, the bucket, and the dipper stick, are calculated.

At step 16 (S16), the velocities of the respective cylinders are modified without varying the velocity ratio between the cylinders within the range of the discharge fluid amount of the current pump. Then, the target cylinder positions $d_{bm}$, $d_{ds}$ and $d_{bk}$ are re-determined correspondingly with the boom angle θbm, the dipper stick angle θds, and the bucket angle θbk for the cylinders.

At step 17 (S17), by utilizing the position values $d_{bm}$, $d_{ds}$ and $d_{bk}$, the controller 130 calculates the target velocities of the respective cylinders for moving to the target positions.

At step 18 (S18), while maintaining the velocity ratio between the respective cylinders and the amount of the fluid dischargeable by the pumps 55, 60 and 65 are corrected.

At step 19 (S19), the position values, which correspond to the current work, and are detected by the position sensor 15 and are compensated, while the fluid amounts dischargeable by the pumps are also compensated.

At step 20 (S20), the compensated values are the commanded values of the main control valve 80 commanding that the required amounts of fluid should be discharged for the respective cylinders. These compensated velocity values of a digital form are converted into analog signals by the first and second D/A converters 35 and 40.

The voltage signals of the converted analog signals are supplied to the first and second amplifiers 36 and 41 to be outputted therefrom in the form of current signals. These current signals are supplied to the first electronic proportional valve 50 and to the second electronic proportional valve 45 for the main control valve.

Thus, the first electronic proportional valve 50 generates a pilot pressure for adjusting the swash plate to send the required amount of fluid to the main control valve 80. Then the spool strokes for the respective attachments (boom, arm, bucket, swinging motor, leftward running motor and rightward running motor) are adjusted by the main control valve 80, so that the fluid from the pumps would be distributed to the respective cylinders.

At step 21 (S21), a judgment is made as to whether or not the operator has inputted a signal for release of the automatic surface finishing work. If a release is inputted, the operation is terminated (exit), while if not inputted, then the system returns to step 7 (S7) (go to S7).

According to the present invention as described above, the automatic surface finishing work with an excavator vehicle is rendered easy, and the work efficiency is improved. Further, non-skilled persons can carry out the surface finishing work, and therefore, labor cost is saved. Further, the surface finishing work is carried out in an automatic manner, and therefore, the work is done precisely.

What is claimed is:

1. A method for surface finishing work with an electronically controlled hydraulic excavator comprising the steps:

inputting a command to operate the electronically controlled hydraulic excavator to excavate the around with a bucket at an angle θ relative to a horizontal reference;

determining if a swinging operation of an upper rotary portion carrying the bucket of the electronically controlled hydraulic excavator about an axis orthogonal to the ground is being performed;

in response to the determined swinging operation of the upper rotary portion calculating a deviation of an end L of the bucket from the angle θ; and compensating for the calculated deviation of the bucket end L from the angle θ automatically by moving the bucket end L from the calculated deviation back to the angle θ for performing the finishing work.

2. A method for surface finishing work with an electronically controlled hydraulic excavator comprising the steps:

determining an initial position of a bucket end L and a pivot point of a bucket joint J in a rectangular coordinate system with an origin of a coordinate system being a connection point A between a boom and an upper rotary portion of the electronically controlled hydraulic excavator;

judging if a control lever is manipulated when carrying out the surface finishing work by driving one of a bucket, a dipper stick or the boom;

calculating a deviation amount of the bucket end L from a desired work angle θ relative to a work plane which is set by a driver of the electronically controlled hydraulic excavator to provide compensation for deviation from the desired work angle θ when the bucket end L deviates from the work plane during revolution of the upper rotary portion of the electronically controlled hydraulic excavator;

calculating a linear velocity of the bucket end L which is proportionate to an actuation of the control lever;

determining linear velocities of a plurality of hydraulic cylinders for driving the bucket, dipper stick and the boom for satisfying a next hydraulic cylinder position $d_i$ of one of the plurality of hydraulic cylinders which is a length between a pivot point B and pivot point C, a next hydraulic position of another one of the plurality of hydraulic cylinders $d_2$ which is a length between a pivot point D and pivot point F and a next hydraulic cylinder position of another one of the plurality of hydraulic cylinders $d_3$ which is the length between a pivot point G and a pivot point I corresponding to revolution angles $\theta_1$, $\theta_2$, $\theta_3$ of the bucket, the dipper stick and the boom;

compensating for the linear velocities of the plurality of hydraulic cylinders based on the next hydraulic cylinder position obtained from a current work status which is measured by a position sensor and is based on a discharged amount of fluid from a plurality of hydraulic pumps providing fluid to the plurality of hydraulic cylinders; and outputting voltages to amplifiers of a main control valve and pump based on compensating for the linear velocities of the plurality of hydraulic cylinders.

3. A method for surface finishing work with an electronically controlled hydraulic excavator comprising the steps:

inputting a desired work angle into a processor;

detecting current signal values of angles for a boom, a dipper stick and a bucket, a turning angle of swinging of an upper portion of the electronically controlled hydraulic excavator, an inclination angle of the upper portion of the electronically controlled hydraulic excavator, and a rolling angle of the electronically controlled hydraulic excavator;

determining a bucket maintaining angle relative to a horizontal plane based on the detected current signal values;

correcting the desired work angle for an absolute horizontal surface relative to the inclination of the electronically controlled hydraulic excavator;

obtaining initial positions of a bucket end and a pivot point of the bucket with respect to a rectangular coordinate system having a first origin;

obtaining the initial position of the bucket end with respect to a rectangular coordinate system having a second origin;

determining if a control level for the dipper stick has been manipulated;

calculating a current position of the pivot point of the bucket relative to the rectangular coordinate system having the first origin when the control level for the dipper stick has been manipulated;

determining if a swinging operation of the upper portion of the electronically controlled hydraulic excavator has been made;

correcting a swinging angle and an inclination angle of the electronically controlled hydraulic excavator if the swinging operation has been made;

calculating and compensating for a deviation of the bucket end from an initially inputted work plane during the swinging operation;

calculating a linear velocity of the bucket end based on an original position of the control lever for the dipper stick;

determining a next position of the pivot point of the bucket relative to the rectangular coordinate system having the first origin;

calculating target angles of the boom, the dipper stick, and the bucket for maintaining an initial bucket angle;

calculating velocities of a plurality of cylinders which respectively drive the bucket, boom and dipper stick;

modifying the calculated velocities of the plurality of cylinders without varying a velocity ratio of the plurality of cylinders within a range of discharge fluid quantity of a plurality of pumps which supply fluid to the plurality of cylinders, and re-setting intended positions of the plurality of cylinders;

calculating target velocities of the plurality of cylinders for arriving at target positions of the bucket, boom and dipper stick;

correcting the calculated target velocities of the plurality of cylinders and current dischargeable amounts of the fluid from the plurality of pumps while maintaining the velocity ratio of the plurality of cylinders;

compensating for the velocity of the plurality of cylinders and the discharge fluid quantity of the plurality of pumps; and outputting voltages to amplifiers of a main control valve and the plurality of pumps based on the compensating for the velocity.

4. A method for according to claim 3, wherein:

the rectangular system has the first origin where the upper portion and the boom are connected together.

5. A method for according to claim 3, wherein the rectangular system having the second origin is a central point of a lower portion of a wheel of the electronically controlled hydraulic excavator.

6. A method for carrying out automatic surface finishing work while compensating for a deviation of a bucket end point L automatically when the bucket end point L departs from a work plane during revolution of an upper rotary portion of an electronically controlled hydraulic excavator comprising the steps:

selecting an automatic surface finishing work and inputting a desired work angle θW into a processor on a keypad by a driver of the electronically controlled excavator;

detecting and reading a current rotational angle of a boom θbm with respect to a pivot point A, a rotational angle of a dipper stick θds with respect to a pivot point E and a rotational angle of bucket θbk with respect to a pivot point H, a revolution angle of an upper rotary portion of the electronically controlled excavator with respect to an axis Y and a slope angle θp, θr of the upper rotary portion with respect to axes Z and X with a plurality of position sensors with the axes X, Y and Z being in a rectangular coordinate system;

determining a bucket maintaining angle θ which is summation of the boom angle θbm, dipper stick angle θds and bucket angle θbk;

correcting a work angle τ to make the desired work angle θW fit to an absolute horizontal plane which is a surface of the earth;

deciding initial positions of a bucket end L and a pivot point of a bucket joint J in a rectangular coordinate system with an origin of the rectangular coordinate system being a connection point A between the boom and the upper rotary portion;

determining the initial position of the bucket end L in a rectangular coordinate system with an origin of the rectangular coordinate system being a central point O touching on the work plane;

judging if a control lever for the dipper stick is manipulated when carrying out the automatic surface finishing work by driving one of an attachment, the bucket, the dipper stick and the boom and outputting voltages to an amplifier of a main control valve and pump if the control lever has not been manipulated;

determining a current position of the bucket joint J in a rectangular coordinate system having an origin at point A after manipulation of the control lever for the dipper stick;

determining if there is a revolving of the upper rotary portion by a driver of the electronically controlled excavator vehicle, and calculating a linear velocity of the bucket end L which is proportionate to actuation of the control lever of the dipper stick if there is no operation;

reading a revolution angle θSW of the upper rotary portion with respect to a Y axis in a coordinate system having X, Y and Z axes and a slope angle, θp or θr of the rotary upper portion with respect to the Z or X axes to correct the work angle T when carrying out revolution of the upper rotary portion;

calculating a deviation amount of the bucket end L from the desired work angle θW to provide compensation for deviation from the desired work angle when the bucket end L departs from the work plane during revolution of the upper rotary portion;

calculating a linear velocity of the bucket end L which is proportionate to actuation of the control lever of the dipper stick;

determining values of a next position to which the pivot point of the bucket joint J is to be positioned in the rectangular coordinate system having the original of a central point O;

determining a boom angle θbm, a dipper stick angle θds for a position of bucket pivot point and a bucket angle θbk for maintaining an initial bucket angle in the coordinate system having the origin at the point A;

determining linear velocities of a plurality of hydraulic cylinders for satisfying next hydraulic cylinder position $d_1$ which is the length between a pivot point B and a pivot point C, another hydraulic cylinder position $d_2$ which is a length between a pivot point D and a pivot point F and another hydraulic cylinder position $d_3$ which is the length between pivot point G and a pivot point I corresponding to the revolution angles θbk, θds, θbm of the bucket, the dipper stick and the boom;

making corrections for possible velocities without varying a velocity ratio of the plurality of hydraulic cylinders within a range of the dischargeable fluid quantity from a plurality of hydraulic pumps which provide fluid to the plurality of hydraulic cylinders and resetting next target positions of the plurality of hydraulic cylinders which drive the boom, dipper and bucket;

calculating target velocities of the plurality of hydraulic cylinders at target positions by utilizing the target positions of the plurality of hydraulic cylinders by a position control section;

correcting target velocities of the plurality of hydraulic cylinders and a current amount of the fluid dischargeable from the plurality of hydraulic pumps, while maintaining the velocity ratio of the plurality of hydraulic cylinders;

compensating target velocities of the plurality of hydraulic cylinders based on the position values obtained from a current work status which is measured by a position sensor and based on a discharged quantity of hydraulic fluid from the plurality of pumps;

converting compensated velocity signals into analog signals by first and second digital to analog converters for outputting a voltage to a first amplifier and to a second amplifier for a main control valve so as to output currents through first and second electronic proportional valves and activating the hydraulic pumps with the output currents to drive the plurality of hydraulic cylinders within the main control valve; and terminating operation after an end of surface finishing work if the driver of the electronically controlled hydraulic excavator has inputted a release signal for the surface finishing work and returning to manipulating the control lever of the dipper stick if the release signal has not been inputted.

* * * * *